US006648411B2

(12) United States Patent
Julien

(10) Patent No.: US 6,648,411 B2
(45) Date of Patent: Nov. 18, 2003

(54) SUSPENDED SEAT

(75) Inventor: Christine E. Julien, Reading, PA (US)

(73) Assignee: Graco Children's Products Inc., Exton, PA (US)

( * ) Notice: Subject to any disclaimer, the term of this patent is extended or adjusted under 35 U.S.C. 154(b) by 42 days.

(21) Appl. No.: 09/968,719

(22) Filed: Oct. 2, 2001

(65) Prior Publication Data

US 2003/0062748 A1 Apr. 3, 2003

(51) Int. Cl.[7] ..... A47D 13/08

(52) U.S. Cl. ..... 297/274; 297/273; 472/135; 482/78

(58) Field of Search ..... 297/273, 274; 267/69, 155, 166; 472/103, 104, 105, 135; 482/77, 78, 75, 143

(56) References Cited

U.S. PATENT DOCUMENTS

| | | | | | |
|---|---|---|---|---|---|
| 73,801 | A | | 1/1868 | Hale | |
| 131,083 | A | * | 9/1872 | Colvin | 297/276 |
| 178,680 | A | | 6/1876 | Shaw | |
| 268,232 | A | | 11/1882 | Hilpert et al. | |
| 279,432 | A | * | 6/1883 | Raymond | 297/274 |
| 285,623 | A | | 9/1883 | Hunzeker | |
| 382,814 | A | | 5/1888 | Jones | |
| 384,512 | A | | 6/1888 | Dillon | |
| 641,316 | A | | 1/1900 | Meyer | |
| 794,484 | A | | 7/1905 | Bowie | |
| 955,954 | A | | 4/1910 | Emerick | |
| 1,055,975 | A | | 3/1913 | Hawk | |
| 1,057,360 | A | * | 3/1913 | Patten | 297/274 |
| 1,126,291 | A | | 1/1915 | Rundle | |
| 1,215,652 | A | | 2/1917 | Hale | |
| 1,339,296 | A | | 5/1920 | Sparks | |
| 1,346,973 | A | | 7/1920 | Padden | |
| 1,354,907 | A | | 10/1920 | Hopaidaszka | |
| 1,369,747 | A | * | 2/1921 | Jordan | 297/273 |
| 1,629,676 | A | | 5/1927 | Buckminster | |
| 1,757,423 | A | | 5/1930 | Gerrond | |
| 2,317,243 | A | | 4/1943 | Anderegg | |
| 2,655,198 | A | | 10/1953 | Williams et al. | |
| 3,314,636 | A | | 4/1967 | McHugh | |
| 3,447,832 | A | | 6/1969 | Shaw | |
| 3,730,587 | A | | 5/1973 | Bloxham et al. | |
| 4,844,452 | A | | 7/1989 | Tomosky et al. | |
| D305,722 | S | | 1/1990 | Riehm | |
| 4,948,120 | A | | 8/1990 | Krueger et al. | |
| 5,288,283 | A | | 2/1994 | Meeker | |
| 5,342,245 | A | * | 8/1994 | Webb, Jr. | 472/118 |
| D355,533 | S | | 2/1995 | Meeker | |
| 5,403,270 | A | | 4/1995 | Schipper | |
| D360,905 | S | | 8/1995 | Meeker et al. | |

(List continued on next page.)

FOREIGN PATENT DOCUMENTS

| | | |
|---|---|---|
| DE | 904 689 | 1/1954 |
| GB | 2 055 592 A | 3/1981 |

*Primary Examiner*—Peter M. Cuomo
*Assistant Examiner*—Joseph Edell
(74) *Attorney, Agent, or Firm*—Foley & Lardner

(57) ABSTRACT

A suspension assembly in a seat has a clamp for coupling the seat to a support and a seat having a seat ring, seat web, and seat material. The suspension assembly comprises a web link having a link slot and is coupled to the clamp. A first web is configured in a closed loop and coupled to the web link through the link slot. A tube defining an interior cavity is provided, with the tube having a spring retainer on one end and an anchor pin on the other end. The anchor pin is threaded through the loop of the first web, wherein the tube is coupled to the web link. A spring is nested in the interior cavity of the tube against the spring retainer. A disk having a disk slot is coupled to a second web at one end of the second web. The other end of the second web is passed through the spring in the tube and coupled to a web spreader. The web spreader has a seat slot wherein the seat web engages the seat slot to suspend the seat assembly.

24 Claims, 3 Drawing Sheets

U.S. PATENT DOCUMENTS 5,445,585 A * 8/1995 Meeker ..... 482/69
5,511,258 A * 4/1996 Barr, Sr. ..... 5/104
D376,264 S 12/1996 Cone et al.
5,624,321 A * 4/1997 Snyder ..... 472/118
5,729,844 A 3/1998 Kerstetter
5,876,311 A * 3/1999 Coates et al. ..... 482/77
5,947,875 A 9/1999 Cone et al.

* cited by examiner

SUSPENDED SEAT

BACKGROUND OF THE INVENTION

The invention relates to seating, and more particularly it is directed to a suspended seat for a child.

Conventional seating assemblies for children, that are suspended, typically are mounted on an independent framework or can be clamped to the lintel of a door frame. Such suspended seat assemblies are also known as "doorway exercises" and "Jumpers." Such suspended seat assemblies typically will utilize extension springs or large rubber bands (a/k/a shock cords) to suspend the seat that holds the child from the supporting structure.

Various methods are employed to improve the aesthetics of the suspended seating assemblies and to minimize injury to the children in the event of failure of one or more parts of the suspended ceiling assembly. For instance, special plating and finishes have been applied to exposed springs. Fabric cords extending through the springs have been used to retain spring parts in the event of failure. One such assembly includes passing a strap through a tube which contains a compression spring with the tube coupled to the seat containing the child. As the seat moves up and down, the spring is compressed and decompressed as the tube moves with the seat, and it rubs and abrades the strap. Such movement can cause fraying and ultimate breakage of the strap, resulting in the spring, tube and related hardware falling down on top of the child seated in the suspended seat.

Thus, there is a need for a suspended seat for use by a child that will maintain the relatively heavy metal parts of the suspended seat in a fixed position relative to the movable seat. There is a further need for a suspended seat that, in the event of breakage of the movable strap suspending the seat, only that strap and the seat assembly will fall. There is also a need for a suspended seat that will easily and readily provide for replacement of parts.

SUMMARY OF THE INVENTION

There is provided a suspension assembly in a seat having a clamp for coupling the seat to a support and a seat assembly having a seat web. The suspension assembly comprises a web link having a link slot and being coupled to the clamp. A first web is configured in a closed loop and coupled to the web link through the link slot. A tube defining an interior cavity is provided, with the tube having a spring retainer on one end and an anchor pin on the other end. The anchor pin is threaded through the loop of the first web, wherein the tube is coupled to the web link. A spring is nested in the interior cavity of the tube against the spring retainer. A disk having a disk slot is coupled to a second web at one end of the second web. The other end of the second web is passed through the spring in the tube and coupled to a web spreader. The web spreader has a seat slot, wherein the seat web engages the seat slot to suspend the seat assembly. Another embodiment of the suspension assembly includes a cap configured to close the tube at one end, with the cap having a cap slot, wherein the loop of the first web is passed through the cap slot. A further embodiment of the suspension assembly can include an adjustment buckle coupled to the second web between the tube and the web spreader.

There is also provided a seat comprising a clamp and a web link having a link slot. The web link is coupled to the clamp. A first web is configured in a closed loop and is coupled to the web link through the link slot. A tube defining an interior cavity is also provided with the tube having a spring retainer on one end and an anchor pin on the other end. The anchor pin is threaded through the loop, wherein the tube is coupled to the web link. A spring is nested in the tube against the spring retainer. A disk having a disk slot is coupled to one end of a second web with the other end of the web passing through the spring in the tube and coupled to a web spreader. The web spreader is provided with a seat slot. A seat assembly is coupled to the web spreader by a seat web.

There is also provided a suspension assembly in a child seat having a clamp for coupling the seat to a support and a seat assembly having a seat web. The suspension assembly comprises a means for linking having a link slot. The means for linking is coupled to the clamp. A first means for suspending is configured in a closed loop and coupled to the means for linking through the link slot. A tube defining an interior cavity is also provided, with the tube having a means for retaining the spring on one end and an anchor pin on the other end. The anchor pin is threaded through the loop, wherein the tube is coupled to the means for linking. A spring is nested in the tube against the means for retaining the spring. A disk having a disk slot is coupled to a second means for suspending. The other end of the second means for suspending is passed through the spring in the tube and coupled to a means for spreading. The means for spreading has a seat slot, wherein the seat web engages the seat slot to suspend the seat assembly.

DETAILED DESCRIPTION OF EXEMPLARY EMBODIMENTS

Before beginning the detailed description of an exemplary embodiment, several general comments are warranted about the applicability and scope of the present invention.

First, the illustrations relate to a seat particularly adapted for children typically from infant to toddler. However, the invention is applicable also to seating for adults and invalids and can be applicable for a person in a prone position.

Figure 1:
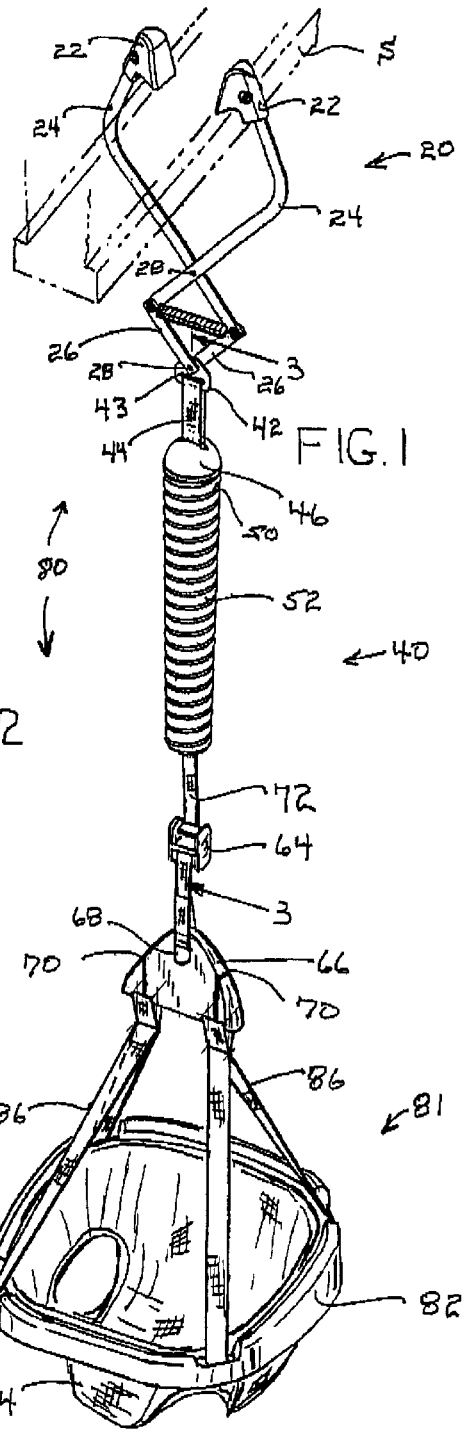
FIG. 1 is a perspective illustration of an exemplary embodiment of a suspended seat.

Second, the seat material is illustrated in a FIG. 1 as padded cloth. While this configuration is presently preferred, a wide variety of seat material configurations and appearances will benefit from the use of the mechanical support and suspension assembly described. The seat material can be a fabric, a plastic, solid or mesh, an air bladder or other materials known and used in the seating art.

Third, with regard to the seat described later herein, substantial modifications can be made without departing from the invention's intended scope. For example, as best seen in FIG. 1, the seat web is illustrated as a strap; however, other mechanical equivalents including, but not limited to, plastic links, coated metal cables, rigid rods, etc., could be employed. Another example is the seat ring. As illustrated in FIG. 1, the seat ring is a single member to which the seat web and seat material is coupled. Mechanical equivalents, including but not limited to, a pair of spaced apart slats, a plurality of vertical rings, etc., could be employed. Yet another example is the clamp. As illustrated in FIG. 1, the clamp is configured to engage the lintel of a door frame; however, the clamp could also be configured to engage a ceiling beam or a tree limb or a free standing support. Further, mechanical equivalents to the clamp, including an eye hook and bolt, a swivel hook, etc., could also be coupled with the suspension assembly of the present invention.

These mechanisms do not, in and of themselves, form part of the present invention, but when combined with the suspension assembly define the invention and result in more comfortable seating for the occupant of the seat.

Referring now to FIG. 1, there is illustrated a seat 80, having a clamp 20, a suspension assembly 40, and a seat assembly 81.

The illustrated clamp 20 includes a pair of clamp arms 24 with each arm 24 having a clamp end 22 coupled thereto. The clamp arms 24 are coupled together with a fastener 28. Each clamp arm has a connecting link coupled to it with a fastener 28. The clamp ends 22 are configured to engage a support S, such as the lintel of a door frame, but can be configured to engage any suitable and convenient support for the seat 80. The fasteners can be in any convenient and conventional configuration such as a rivet, screw, nut and bolt, or the like.

Referring now to FIGS. 1, 2, 3 and 4, there is illustrated an exemplary embodiment of a suspension assembly 40, which includes a web link 42 having a link slot 43. The web link 42 is coupled to the clamp 20 with the connecting links 26 and a fastener 28. The link slot 43 can be formed in the web link 42 by any convenient and conventional method such as laser burning, stamping, milling or drilling, etc. A first web 44 is configured in a closed loop and is coupled to the web link 42 through the link slot 43. During assembly, one end of the first web 44 is threaded through the link slot 43 and connected to the other end of the first web 44 to form the closed loop. The first web 44 can be formed in the closed loop by any convenient and conventional way, with the preferred way being machine stitching using a box stitch. However, it is also contemplated that a mechanical fastener such as a rivet or suitable adhesive can also be utilized to attach the two ends of the first web 44 to form the closed loop. Another embodiment contemplates an open loop of the first web 44, as explained below.

The suspension assembly 40 also includes a tube 52 which defines an interior cavity 56. The tube 52 has a spring retainer 54 on one end of the tube and an anchor pin 50 on the opposite end or other end of the tube 52. The anchor pin 50 is configured to extend through the full diameter of the tube 52. During assembly of the suspension assembly 40, the anchor pin 50 is threaded through the loop in the first web 44, wherein the tube 52 is coupled to the web link 42. The anchor pin can be a suitably sized bolt and nut assembly or can be a rivet. It is also contemplated that each side of the closed loop of the first web 44 can be fastened to diametrically opposing sides of the tube 52. It is further contemplated that the first web 44 be configured as an open loop with each end of the first web 44 being fastened to diametrically opposite sides of the tube 52. In any case, the tube 52 is coupled to the web link 42 by the first web 44.

The tube 52 can be composed of metal, engineered plastic, fiberglass or the like. The tube 52 can also be either flexible or rigid. The illustrated exemplary embodiment depicts a rigid, plastic tube. The tube 52, as well as the other parts of the seat 80, can be color coordinated as selected by the designer and manufacturer.

A spring 62 is nested in the interior cavity 56 of the tube 52 and abuts against the spring retainer 54. See FIGS. 3 and 4. The spring 62 can be a compression spring as illustrated and configured to be completely enclosed within the tube during normal operation of the suspension assembly 40.

The spring retainer 54 can be molded in the wall of the tube 52 and extend into the interior cavity 56. The spring retainer 54 can also be a single annular bead around the perimeter of the tube 52 or a series of individual beads. The spring retainer 54 could also be a fastener, such as a rivet, for example, extending through the tube 54 wall and engaging to secure the spring 62 within the tube 52. The spring retainer 54 can also be a tapered configuration of the interior cavity 56 of the tube such that the diameter of the tube 52 at one end (lower end) is smaller than the outer diameter of the coiled spring 62, wherein the spring 62 is inhibited from moving out the tube 52 at such lower end.

Figure 2:
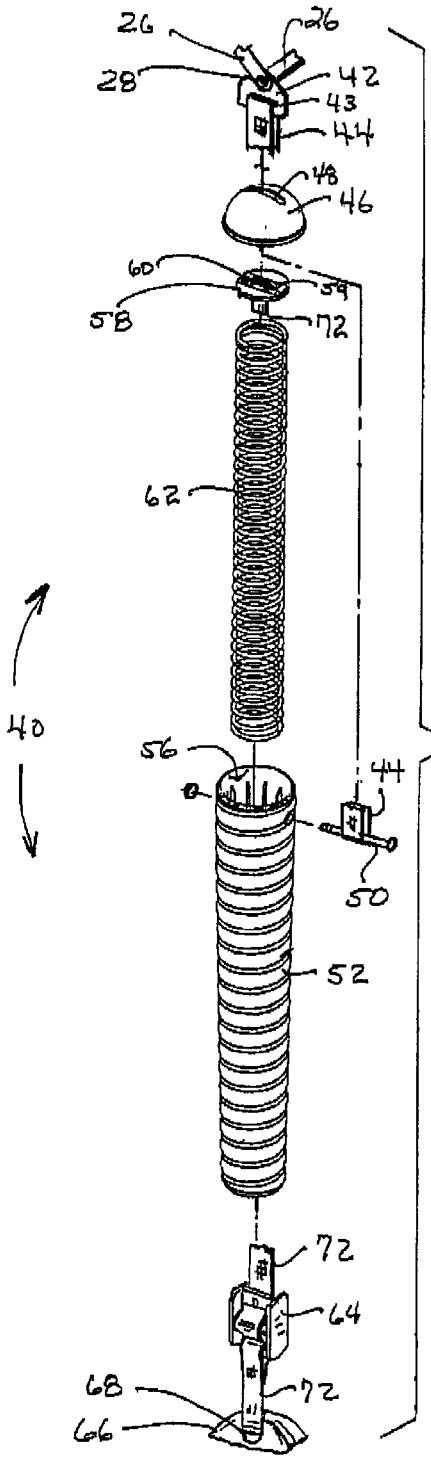
FIG. 2 is an exploded, perspective illustration of an exemplary embodiment of a suspension assembly of a suspended seat.
Figure 3:
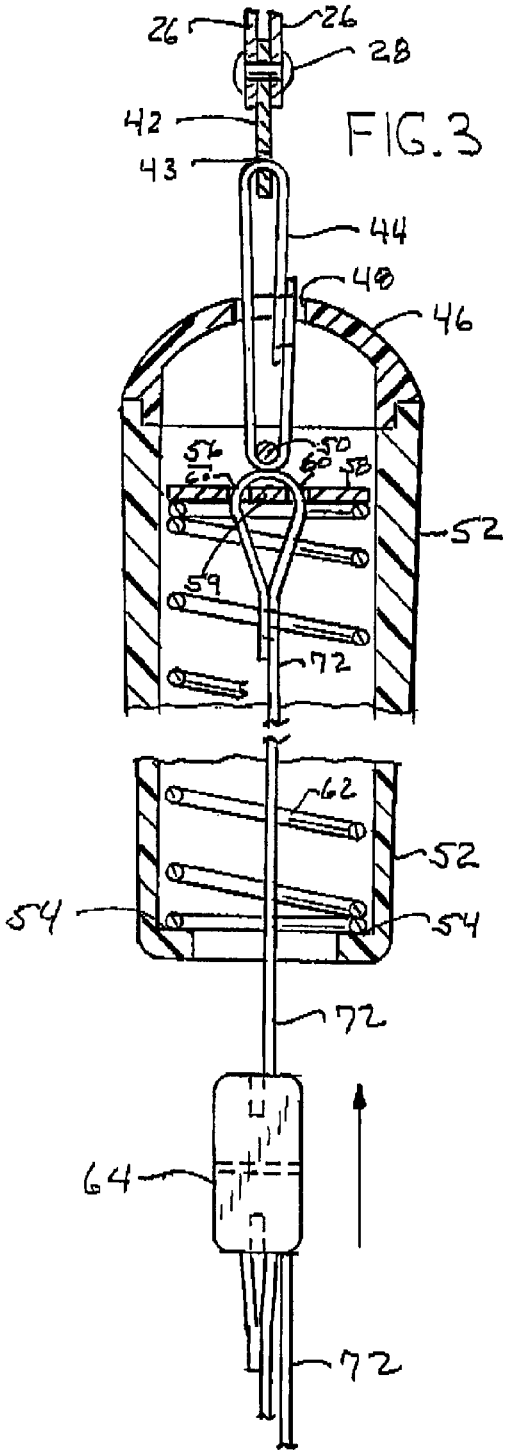
FIG. 3 is a partial, sectional view of the suspension assembly illustrated in FIG. 1 along line 3—3 and illustrating the spring in a decompressed condition and an embodiment of the second web having one end coupled to the disk.
Figure 4:
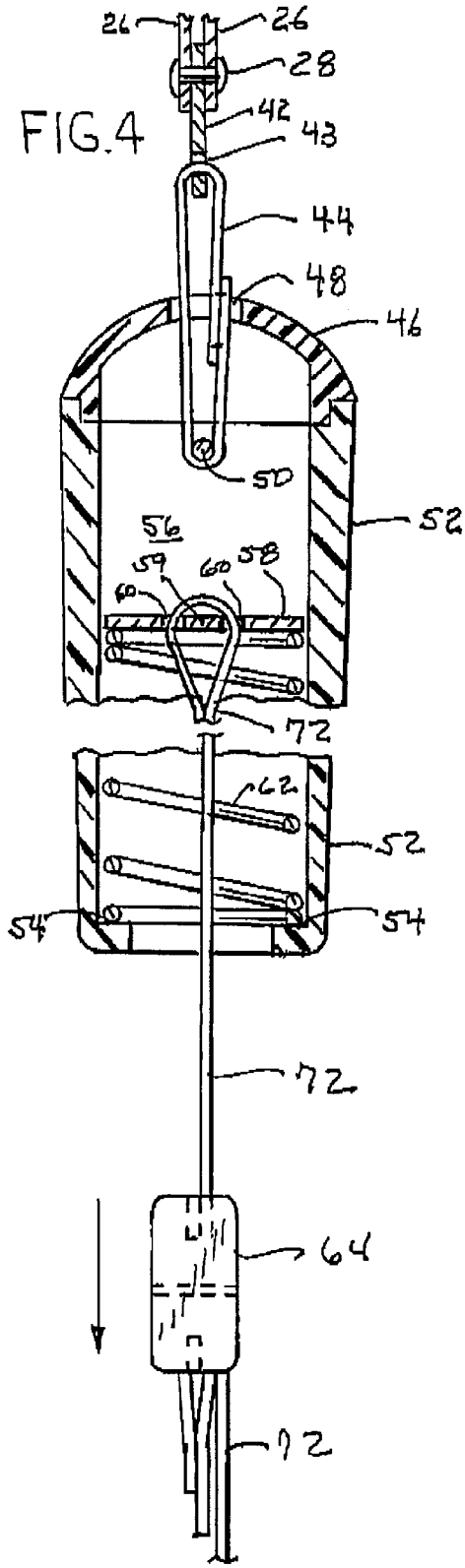
FIG. 4 is a partial sectional view of the suspension assembly illustrated in FIG. 3, illustrating the spring in a compressed condition.
Figure 5:
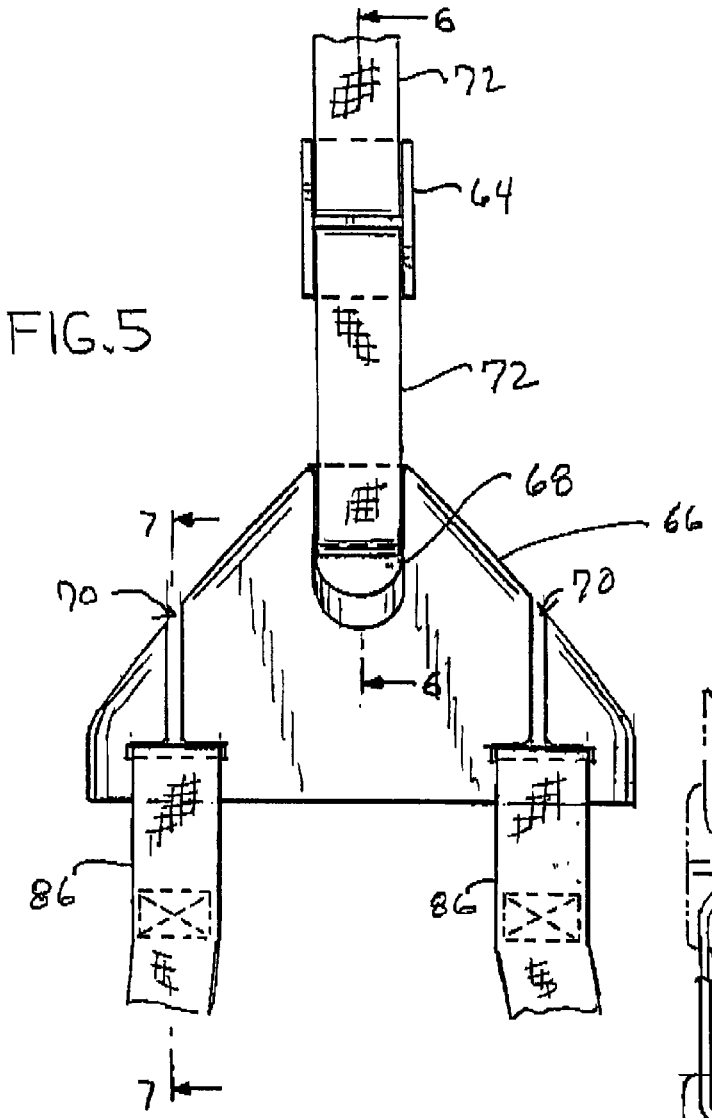
FIG. 5 is a partial plan view of the web spreader and one end of the second web illustrated in FIG. 1.
Figure 6:
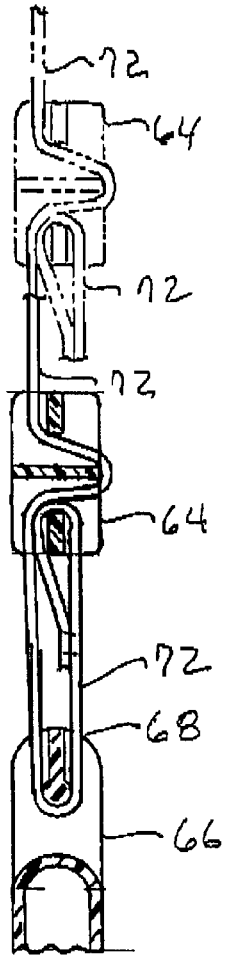
FIG. 6 is a partial, sectional view of the web spreader and second web illustrated in FIG. 5 along the line 6—6 and illustrating one embodiment of an end of the second web coupled to the web spreader and adjustment buckle.
Figure 7:
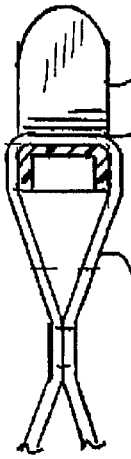
FIG. 7 is a partial, sectional view of the web spreader illustrated in FIG. 5 along the line 7—7, illustrating a seat web coupled in a seat slot.

A disk 58, as best seen in FIGS. 2, 3 and 4, having a disk slot 60 is provided to abut against the spring 62 below the anchor pin 50 and in the interior cavity 56 of the tube 52. The disk slot 60 can be formed in the disk 58 by any convenient and conventional method, such as laser cutting, stamping, milling or drilling. The disk slot 60, as illustrated, includes two openings, with one opening on each side of a portion of the disk 58 defining a traverse portion 59. Another embodiment of the disk 58 can provide a traverse pin extending over a single opening disk slot 60. The disk 58 is configured to slidingly fit within the interior cavity 56 of the tube 52 but be equal to or exceed the outer diameter of the spring 62.

Referring now to FIGS. 3–7, a second web 72 is coupled at one end to the disk 58. An end of the second web 72 is threaded through the disk slot 60, over the traverse portion 59 and back through the disk slot 60 with the end of the second web 72 then box stitched to itself forming a loop wherein the second web 72 is coupled to the disk 58. The other end of the second web 72 is passed through the spring 62 in the tube 52 and coupled to a web spreader 66. An end of the second web 72 passes through a suspension slot 68 provided in the web spreader 66 with that end of the second web 72 stitched to itself with a box stitch, thereby coupling the second web 72 to the web spreader 66. It is also contemplated that each end of the second web 72 after threading through the disk slot 60 and the suspension slot 68 can be doubled-up on itself or be secured to a stop (for example, an elongated pin or a disk), or any combination thereof, to prevent the second web 72 from releasing from such slots 60, 68.

The web spreader 66 is provided with a pair of seat slots 70 with the seat slots configured to engage the seat web 86 to suspend the seat assembly 81. The web spreader 66 can be formed from a metal or an engineered plastic and can be machined or molded to provide the appropriate shape and slots 68, 70. The web spreader 66 is in a spaced apart relationship from the tube 52.

A seat assembly 81 including a seat ring 82 is coupled to the web spreader 66 by a seat web 86. The seat material 84 is coupled to the seat ring 82.

The suspension assembly 40 of the seat 80 can also be provided with a cap 46 configured to enclose the end of the tube 52 having the anchor pin 50, as illustrated in FIGS. 2, 3 and 4. The cap is provided with a cap slot 48 through which the first web 44 is threaded so that the cap can be moved along the first web 44 and between the web link 42 and the tube 52.

The suspension assembly 40 of the seat 80 can also be provided with an adjustment buckle 64 coupled to the second web 72 between the tube 52 and the web spreader 66. See FIGS. 1, 3 and 4. The adjustment buckle 64 is used to adjust the height of the seat assembly 81 between the bottom of the tube 52 and the surface underneath the seat assembly 81. The adjustment buckle 64 can be composed of metal or engineered plastic and configured in any convenient and conventional size.

One advantage of the suspended seat 80 is that it is easily and readily repaired. For instance, if the web spreader 66 breaks, such as severing through a seat slot 70, only the web spreader 66 needs replacement. Some prior art seats have a strap or web spreader integral with the tube and therefore a more expensive element must be replaced if the strap spreader is broken. Further, repair of such prior art devices is much more complex because more of the doorway jumper must be disassembled to do the repair.

The first and second webs 44, 72 can be composed of a braided or a woven material, such as nylon strands or high density polyethylene strands or polyester strands or other suitable material, and can be dyed to a color appropriate for the aesthetic treatment selected by the manufacturer or user of the seat 80.

In operation, the seat 80 is suspended from a support 5, such as a lintel of a door frame by engaging the clamp 20 to the support S. The distance of the seat assembly 81 from the surface beneath the seat assembly is adjusted with the adjustment buckle 64. An occupant is placed in the seat assembly 81 with the seat ring 82 and the seat material 84 supporting the occupant. The weight of the occupant puts a downward force on the seat web 86 which in turn pulls on the web spreader 66 and thereby pulls the second web 72 against the disk 58 and compresses the spring 62. Because the tube 52 is coupled to the web link 42 and the clamp 20, the tube 52 does not move with the web spreader 66 and seat assembly 81. The occupant in the seat assembly 81 of the seat 80 can move in an up and down direction, or jumping motion, as well as rotate in a clockwise or counterclockwise direction. The rotation is facilitated by the flexibility of the second web 72, as well as a sliding motion of the disk 58 on the spring 62 within the tube 52.

Thus, there has been provided a suspended seat that will maintain the relatively heavy metal parts of the suspended seat in a fixed position relative to the movable seats and provides a seat that, in the event of breakage of the removable strap suspending the seat, only that strap and the seat assembly will fall. There is also provided a suspended seat that is easily and readily repaired. In the drawings, specific examples, and the particular exemplary embodiments of the present invention serve for the purpose of illustration only. The materials, systems and configurations shown and described are not limited to the precise details or conditions disclosed. For example, the web link 42 can include a swivel link which will allow a more ready rotation of the seat assembly and the suspension assembly of the seat. The seat ring can be configured into various child appealing caricatures and can be provided with fixed or removable accessories such as rattles, mobiles and the like. Furthermore, other substitutions, modifications, changes and omissions may be made into the design, operation, operating conditions and arrangements of the exemplary embodiments without departing from the scope of the invention as expressed in the appended claims.

What is claimed is:

1. A suspension assembly in a seat having a clamp for coupling the seat to a support and a seat assembly having a seat web, the suspension assembly comprising:

a web link coupled to the clamp;

a first web coupled to the web link;

a tube defining an interior cavity, wherein the tube has a spring retainer on one end and an anchor pin on the other end, wherein the anchor pin is coupled to the first web, and wherein the tube is coupled to the web link;

a spring nested in the tube against the spring retainer;

a disk having;

a web spreader; and a second web having one end coupled to the disk and the other end passing through the spring and coupled to the web spreader, wherein the seat web engages the web spreader to suspend the seat assembly.

2. The suspension assembly of claim 1, wherein the spring retainer is molded in the interior cavity of the tube.

3. The suspension assembly of claim 1, including a cap configured to close the tube at one end, wherein the cap has a cap slot, wherein the first web is configured in a closed loop, and wherein the loop of the first web passes through the cap slot.

4. The suspension assembly of claim 1, wherein the second web is secured to itself after passing through a suspension slot in the web spreader.

5. The suspension assembly of claim 1, including an adjustment buckle coupled to the second web between the tube and the web spreader.

6. The suspension assembly of claim 5, wherein the second web is secured to itself after passing through a suspension slot in the web spreader.

7. The suspension assembly of claim 1, wherein the first web is fastened to the tube.

8. The suspension assembly of claim 1, wherein the first and second web are composed of one of a braided and woven material.

9. A seat comprising:

a clamp;

a web link coupled to the clamp;

a first web coupled to the web link;

a tube defining an interior cavity, wherein the tube has a spring retainer on one end and an anchor pin on the other end, wherein the anchor pin is coupled to the first web, and wherein the tube is coupled to the web link;

a spring nested in the tube against the spring retainer;

a disk;

a web spreader; and a second web having one end coupled to the disk and the other end passing through the spring and coupled to the web spreader; and a seat assembly coupled to the web spreader.

10. The seat of claim 9, wherein the spring retainer is molded in the interior cavity of the tube.

11. The seat of claim 9, including a cap configured to close the tube at one end, wherein the cap has a cap slot, wherein the first web is configured in a closed loop, and wherein the loop of the first web passes through the cap slot.

12. The seat of claim 9, wherein the second web is secured to itself after passing through a suspension slot in the web spreader.

13. The seat of claim 9, including an adjustment buckle coupled to the second web between the tube and the web spreader.

14. The seat of claim 13, wherein the second web is secured to itself after passing through a suspension slot in the web spreader.

15. The seat of claim 9, wherein the first web is fastened to the tube.

16. The seat of claim 9, wherein the first and second web are composed of one of a braided and woven material.

17. A suspension assembly in a child seat having a clamp for coupling the seat to a support and a seat assembly having a seat web, the suspension assembly comprising:

a means for linking coupled to the clamp;

a first means for suspending coupled to the means for linking;

a spring;

a tube defining an interior cavity, wherein the tube has a means for retaining the spring on one end and an anchor pin on the other end, wherein the anchor pin is coupled to the first means for suspending, wherein the spring is nested in the tube against the means for retaining the spring, and wherein the tube is coupled to the means for linking;

a disk;

a means for spreading;

a second means for suspending having one end coupled to the disk and the other end passing through the spring and coupled to the means for spreading, wherein the seat web engages the means for spreading to suspend the seat assembly.

18. The suspension assembly of claim 17, wherein the means for retaining the spring is molded in the interior cavity of the tube.

19. The suspension assembly of claim 17, including a means for capping configured to close the tube at one end, wherein the means for capping has a cap slot, wherein the first means for suspending is configured in a closed loop, and wherein the loop of the first means for suspending passes through the cap slot.

20. The suspension assembly of claim 17, wherein the second means for suspending is secured to itself after passing through a suspension slot in the means for spreading.

21. The suspension assembly of claim 17, including means for adjusting coupled to the second means for suspending between the tube and the means for spreading.

22. The suspension assembly of claim 21, wherein the second means for suspending is secured to itself after passing through a suspension slot in the means for spreading.

23. The suspension assembly of claim 17, wherein the first means for suspending is fastened to the tube.

24. The suspension assembly of claim 17, wherein the first and second means for suspending are composed of one of a braided and woven material.

* * * * *